US005858118A

United States Patent [19]

Shah et al.

[11] Patent Number: 5,858,118

[45] Date of Patent: Jan. 12, 1999

[54] STAINLESS STEEL ALKALI TREATMENT

[75] Inventors: Sadiq Shah, St. Louis; Fred Kirchner, St. Charles, both of Mo.

[73] Assignee: Calgon Vestal, Inc., Mentor, Ohio

[21] Appl. No.: 904,560

[22] Filed: Aug. 4, 1997

Related U.S. Application Data

[63] Continuation of Ser. No. 570,151, Dec. 11, 1995, abandoned, which is a continuation of Ser. No. 312,385, Sep. 26, 1994, abandoned.

[51] Int. Cl.[6] ..... B08B 3/08

[52] U.S. Cl. ..... 134/29; 510/245; 510/258

[58] Field of Search ..... 134/2, 3, 22.14, 134/22.19, 27, 28, 29, 41; 148/272, 274; 516/266, 245, 258, 279

[56] References Cited

U.S. PATENT DOCUMENTS

| | | | |
|---|---|---|---|
| 3,072,502 | 1/1963 | Alfano | 134/3 |
| 3,077,454 | 2/1963 | Monroe et al. | 507/244 |
| 3,154,438 | 10/1964 | Keller et al. | 148/255 |
| 3,308,065 | 3/1967 | Lesinski | 134/42 |
| 3,368,913 | 2/1968 | Ziehr et al. | 427/309 |
| 3,413,160 | 11/1968 | Teumac | 148/241 |
| 3,438,811 | 4/1969 | Harriman et al. | 134/2 |
| 3,519,458 | 7/1970 | Rausch | 427/156 |
| 3,549,538 | 12/1970 | Jacklin | 134/22.19 |
| 3,865,628 | 2/1975 | Callahan et al. | 134/29 X |
| 4,045,253 | 8/1977 | Banks | 148/250 |
| 4,454,046 | 6/1984 | Wallace et al. | 210/698 |
| 4,590,100 | 5/1986 | Hearst | 427/327 |
| 5,039,349 | 8/1991 | Schoeppel | 134/26 |
| 5,252,363 | 10/1993 | Anderson | 427/386 |
| 5,321,061 | 6/1994 | Anderson | 523/402 |

OTHER PUBLICATIONS

CRC Handbook of Chemistry and Physics, 56th Edition, p. F–152.

"Corrsion Basics, An Introduction," National Association of Corrosion Engineers, pp. 41–42 (1984).

"The Fundamentals of Corrosion," J.C. Sculley, pp. 112–123.

"Metallurgy for Engineers," E.C. Rollason, pp. 246–249.

"An Introduction to Corrosion and Protection of Metals," G. Wranglen, pp. 78–83.

*Primary Examiner*—Jill Warden
*Assistant Examiner*—Saeed Chaudhry
*Attorney, Agent, or Firm*—Fay, Sharpe, Beall, Fagan, Minnich & McKee

[57] ABSTRACT

The invention includes a method for cleaning and passivating a stainless steel surface comprising:

1) contacting the surface with 15–45 ml/liter of a composition consisting essentially of between about 15 and 50% alkaline component, between about 1 to 15% chelant, and between about 35 to 84% water;
2) maintaining contact to dislodge and remove residue from the surface;
3) continuing contact to complex free iron ions liberated from the surface with the chelant to form an oxide film on the surface; and
4) continuing contact to precipitate the complexed ions into the oxide film.

The compositions may further include a surfactant selected from the group consisting of anionic, cationic, nonionic and zwitterionic surfactants to enhance cleaning performance.

5 Claims, No Drawings

STAINLESS STEEL ALKALI TREATMENT

CONTINUING DATA

This application is a continuation of U.S. Ser. No. 08/570,151, filed Dec. 11, 1995, now abandoned, which is a continuation of U.S. Ser. No. 08/312,385, filed Sep. 26, 1994, now abandoned.

BACKGROUND OF THE INVENTION

The present invention relates to compositions and methods for cleaning and passivating stainless steel surfaces, such as gas flow equipment, pharmaceutical manufacturing equipment, and semiconductor processing equipment.

During the past fifteen years the requirements for cleanliness in semiconductor processing equipment have increased at least a hundred times. Semiconductor feature sizes have been cut in half in the past few years and packing densities have doubled or tripled in the same time period. It also appears that the rate of change is accelerating rather than holding at past rates. With these changes, the problems caused by contamination in semiconductor processing become even more serious. Cleanliness is also important in the health and pharmaceutical industries, driven by the need to reduce the contamination of treatment processes.

In the past, stainless steel equipment used in these processes have been cleaned almost universally by use of solvents. In addition to the problems of atmospheric pollution and operator health hazards, solvents do not clean absolutely. They leave films and particle residuals. Ultrasonic cleaning may also drive particles into crevices in instrument parts, for a later release. Chlorofluorocarbon cleaning solvents sold under the trademark Freon are examples of known cleaning solvents as well as 1,1,1-trichloroethane and methylene chloride.

The lack of cleanliness of the components cleaned by conventional solvents, methods and apparatus is problematical where active ions and organic contamination such as organic films remain on the components. Active ions, e.g. metallic ions, can adversely affect the process in which the equipment is to be used.

Passivation of cleaned steel surfaces is important for preventing conditions such as flash rusting of cleaned wet steel.

In the prior art, cleaned steel is often passivated by treating with a nitric acid solution to provide altered surface characteristics that resist rusting. Dilute solutions of citric acid made alkaline with ammonia or with an amine have been used for passivation of cleaned steel surfaces. These same solutions also have been used in combination with sodium nitrite.

Water-soluble amines are sometimes added to latex or water-dispersed coatings for steel to reduce corrosion. Water-soluble amines also have been added to final rinses for cleaned steel, but always in combination with other materials (such as other alkaline chemicals, citric acid, sodium nitrite, etc., and as exemplified in U.S. Pat. Nos. 3,072,502; 3,154,438; 3,368,913; 3,519,458; and 4,045,253) and therefore these rinses have left insoluble residues on the steel surfaces that are detrimental to optimum performance of subsequently applied protective coatings.

In the prior art, cleaned steel is often passivated by treating with an alkaline sodium nitrite solution to provide altered surface characteristics that resist rusting. For unknown reasons, this method is sometimes ineffective for passivating cleaned steel.

Dilute solutions of citric acid made alkaline with ammonia or with an amine have been used for passivation of cleaned steel surfaces. These same solutions also have been used in combination with sodium nitrite.

U.S. Pat. No. 4,590,100 describes a process that allows previously cleaned steel to be passivated with a rinse of almost pure water, that is made slightly alkaline with an amine to inhibit corrosion preparatory to application of non-aqueous protective coatings, such that any small amine residue remaining on the steel surface after drying of the water will itself evaporate and in such a manner that any remaining amine residue will be incorporated into the non-aqueous protective coating without leaving any water-soluble or ionic residue on the surface of the steel.

U.S. Pat. Nos. 5,252,363 and 5,321,061 describe aqueous organic resin-containing compositions which are useful for depositing coatings on freshly galvanized metals to protect the metals against white rust and provide a surface which is universally paintable. The organic resin consists essentially of at least one water-dispersible or emusifiable epoxy resin or a mixture of resins containing at least one water-dispersible or emulsifiable epoxy resin.

U.S. Pat. No. 5,039,349 describes a method and apparatus for cleaning surfaces, such as semiconductor processing equipment and pharmaceutical processing equipment, to absolute or near-absolute cleanliness involving spraying jets of heated cleaning solution so that it flows over and scrubs the surfaces to be cleaned, producing a rinse liquid. The rinse liquid is filtered and recirculated over the surface to be cleaned.

It is a purpose of the present invention to provide alkali-based formulations which both clean and passivate stainless steel surfaces.

SUMMARY OF THE INVENTION

The invention is a method for treating stainless steel that both cleans and passivates the stainless steel surface. Specifically, the invention is a method for cleaning and passivating a stainless steel surface comprising:

1) contacting the surface with 15–48 ml/liter of a composition comprising between about 15 and 50% alkaline component, between about 1 to 15% chelant, and between about 35 to 84% water;
2) maintaining contact to dislodge and remove residue from the surface;
3) continuing contact to complex free iron ions liberated from the surface with the chelant to form an oxide film on the surface; and
4) continuing contact to precipitate the complexed ions into the oxide film.

The compositions may further include a surfactant selected from the group consisting of anionic, cationic, nonionic and zwitterionic surfactants to enhance cleaning performance.

DETAILED DESCRIPTION OF THE INVENTION

Compositions which are used for treating stainless steel according to the present invention include an alkaline component, a chelant, and water. The compositions treat the stainless steel surface by removing residue, formed on the stainless steel surface during use of the stainless steel surface (e.g., during pharmaceutical or semiconductor processing), from the surface, simultaneously complexing free iron ions liberated from the stainless steel surface with a chelant and forming an oxide film on the stainless steel surface, and precipitating the complexed ions into the oxide film.

Compositions of the invention comprise between about 15 and 50% alkaline component, between about 1 to 15% chelant, and between about 35 to 84% water. Unless otherwise indicated, all amounts are percentages are weight/weight.

The compositions may further include 1–15% surfactant selected from the group consisting of anionic, cationic, nonionic and zwitterionic surfactants to enhance cleaning performance. Examples of such surfactants include but are not limited to water-soluble salts or higher fatty acid monoglyceride monosulfates, such as the sodium salt of the monosulfated monoglyceride of hydrogenated coconut oil fatty acids, higher alkyl sulfates such as sodium lauryl sulfate, alkyl aryl sulfonates such as sodium dodecyl benzene sulfonate, higher alkyl sulfoacetates, higher fatty acid esters of 1,2 dihydroxy propane sulfonates, and the substantially saturated higher aliphatic acyl amides of lower aliphatic amino carboxylic acid compounds, such as those having 12 to 16 carbons in the fatty acid, alkyl or acyl radicals, and the like. Examples of the last mentioned amides are N-lauroyl sarcosine, and the sodium, potassium, and ethanolamine salts of N-lauroyl, N-myristoyl, or N-palmitoyl sarcosine.

Additional examples are condensation products of ethylene oxide with various reactive hydrogen-containing compounds reactive therewith having long hydrophobic chains (e.g. aliphatic chains of about 12 to 20 carbon atoms), which condensation products ("ethoxamers") contain hydrophilic polyoxyethylene moieties, such as condensation products of poly (ethylene oxide) with fatty acids, fatty alcohols, fatty amides, polyhydric alcohols (e.g. sorbitan monostearate) and polypropyleneoxide (e.g. Pluronic materials).

Miranol JEM, an amphocarboxylate surfactant available from Rhone-Poulenc, Cranbury, N.J., is a typically suitable surfactant.

Alkaline components suitable for the present invention are hydroxide salts including, but not limited to, sodium hydroxide, potassium hydroxide, and quaternary ammonium hydroxide. Such quaternary ammonium hydroxides include, but are not limited to, unsubstituted alkyl quaternary ammonium hydroxides such as tetramethyl ammonium hydroxide, tetraethyl ammonium hydroxide, tetrapropyl ammonium hydroxide, tetrabutyl ammonium hydroxide, and unsubstituted alkyl and aryl substituted ammonium hydroxides, including trimethylphenyl ammonium hydroxide and tripropylphenyl ammonium hydroxide. Alkaline salts such as carbonate salts are not suitable for the present invention.

Chelants especially suitable for the present invention include ethylenediaminetetraacetate, hydroxyacetic acid, hydroxylamino-tetraacetate and citric acid. Sodium gluconate is suitable but less preferred than the especially suitable chelants. Chelants such as polyacrylic acid, and Miranol JEM are not suitable for the present invention.

Water suitable for the present invention can be distilled water, soft water or hard water. Very hard water (e.g. 500 ppm) is also suitable if the amount of chelant is sufficiently higher than that which sequesters the metal ions such as calcium and magnesium.

Optionally, compositions of the invention can include more than one alkaline component and more than one chelant.

The stainless steel surfaces are treated by diluting the composition described above (which includes an alkaline component, a chelant, and water) to a concentration of 15–45 ml/liter to form a dilute solution, contacting the solution with the stainless steel surface to dislodge and remove residue from the surface, continuing contact to complex frree ion liberated from the surface with the chelant to form an oxide film on the surface, and precipitating the complexed ions into the oxide film.

A preferred method of the invention comprises:

1) contacting the surface with 22–38 ml/liter of a composition comprising between about 20 and 35% alkaline component, between about 2 and 8% chelant, and between about 57 and 78% water;
2) maintaining contact to dislodge and remove residue from the surface;
3) continuing contact to complex free iron ions liberated from the surface with the chelant to form an oxide film on the surface; and
4) continuing contact to precipitate the complexed ions into the oxide film.

One embodiment of the preferred method of the invention comprises:

1) contacting the surface with 22–38 ml/liter of a composition comprising between about 20 and 35% potassium hydroxide, between about 2 and 8% ethylenediaminetetraacetate, and between about 57 and 78% water;
2) maintaining contact to dislodge and remove residue from the surface;
3) continuing contact to complex free iron ions liberated from the surface with the chelant to form an oxide film on the surface; and
4) continuing contact to precipitate the complexed ions into the oxide film.

Another embodiment of the preferred method of the invention comprises:

1) contacting the surface with 22–38 ml/liter of a composition comprising between about 20 and 35% sodium hydroxide, between about 2 and 8% ethylenediaminetetraacetate, and between about 57 and 78% water;
2) maintaining contact to dislodge and remove residue from the surface;
3) continuing contact to complex free iron ions liberated from the surface with the chelant to form an oxide film on the surface; and
4) continuing contact to precipitate the complexed ions into the oxide film.

In one particular embodiment of the invention, materials such as pharmaceutical products present in stainless steel manufacturing vessels to be cleaned and passivated are removed from the vessel. While the bulk of the material to be removed readily flows from the stainless steel vessel, a residue film remains on the stainless steel surface.

Compositions used in the present invention are contacted with the film-coated surface in one or more of several ways. One way to contact the film-coated surface is by using a fixed spray-ball mechanism which showers the composition onto the film-coated surface such that all film-coated surfaces are contacted with the composition. Another way to contact the film-coated surface is by using a flexible spray-ball mechanism which, at various positions within the vessel, showers the composition onto the film-coated surface such that all film-coated surfaces are contacted with the composition. Another way is to fill the vessel such that all film-coated surfaces are contacted with the composition.

After contact is initiated, the film is dislodged and solubilized, dispersed, or emulsified into the composition and removed from the vessel. Free iron ions are liberated from the surface and form an oxide film on the surface The complexed ions of iron are precipitated into the oxide film. The composition removed from the vessel is optionally discarded or recycled.

Using the method of the invention, stainless steel can be cleaned and passivated in one treatment. The method provides a passive protective film in addition to cleaning stainless steel surfaces.

In Example 2 below, water alone, potassium hydroxide alone, and compositions including an alkaline component, a chelant, and water, were evaluated.

Table 2 in Example 2 represents data obtained from studies evaluating the passivation properties of compositions of the invention. Corrosion, measured electrochemically in mils per year (MPY), is initially high, but drops signficantly and remains low after a passive film is formed. Subsequent exposure of these passivated electrodes to fresh solutions of the same formulation results in no rise in corrosion rate, due to the protective effect of the passive film previously formed.

The passivation property is the result of chelation properties of the chelant. As the corrosion reaction is initiated the free iron ions liberated are complexed by the chelant. An oxide film forms on the metal surface upon exposure to the alkaline component. The complexes readily precipitate and incorporate into the oxide film, enhancing the integrity of the oxide film.

EXAMPLE 1 (control)

Stainless steel 316 (*CRC Handbook of Chemistry and Physics,* 56th Edition, p. F-152, defines 316 stainless steel as containing a Co/Ni/Mo percentage of 16/10/2 or 18/14/3 percent respectively) electrodes were treated with a 34% nitric acid solution, a standard solution used for passivating stainless steel surfaces. A corrosion rate profile was generated by immersing the electrodes in a fresh diluted solution, and monitoring the corrosion rate, measured electrochemically, in mils per year. The profile showed initial corrosion for a short period of time, resulting in formation of a protective film, followed by an extended period of time showing virtually no additional corrosion.

EXAMPLE 2

Compositions having the following formulation were prepared by adding potassium hydroxide to water, followed by addition of chelant, either ethylenediaminetetraacetate (EDTA), sodium gluconate, polyacrylic acid, or Miranol JEM:

TABLE 1

| | Formulation | | | |
|---|---|---|---|---|
| Ingredient | 1 | 2 | 3 | 4 |
| KOH (45%) | 46% | 46% | 46% | 46% |
| EDTA (39%) | 10 | — | — | — |
| sodium gluconate | — | 5 | — | — |
| polyacrylic acid | — | — | 1 | — |
| Miranol JEM | — | — | — | 2 |
| Water (soft) | 44 | 49 | 53 | 52 |
| Total | 100% | 100% | 100% | 100% |

Each formulation was evaluated by diluting to a concentration of 31 ml/liter, immersing stainless steel 316 electrodes with the diluted formulation at 80° C., and monitoring the corrosion rate, as measured in mils per year. Water alone and potassium hydroxide alone were also evaluated. Table 2 shows the corrosion rate achieved using Formulations 1, 2, 3 or 4 described in Table 1, KOH (20%), or water.

TABLE 2

| | Corrosion rate | | | | | |
|---|---|---|---|---|---|---|
| Time | 1 | 2 | 3 | 4 | KOH (20%) | water |
| 5 minutes | 0.8 | 0.2 | 0.09 | 0.1 | 0.15 | 0.05 |
| 10 minutes | 0.5 | 0.1 | 0.08 | 0.1 | 0.15 | 0.05 |
| 20 minutes | 0.3 | 0.1 | 0.09 | 0.1 | 0.1 | 0.05 |
| 30 minutes | 0.2 | 0.1 | 0.09 | 0.1 | 0.1 | 0.05 |
| 40 minutes | 0.2 | 0.1 | 0.09 | 0.1 | 0.1 | 0.05 |
| 50 minutes | 0.15 | 0.08 | 0.08 | 0.08 | 0.1 | 0.05 |
| 1 hour | 0.15 | 0.08 | 0.08 | 0.08 | 0.1 | 0.05 |
| 2 hours | 0.1 | 0.07 | 0.07 | 0.07 | 0.1 | 0.05 |
| 3 hours | 0.1 | 0.07 | 0.07 | 0.07 | 0.1 | 0.05 |
| 4 hours | 0.1 | 0.07 | 0.07 | 0.07 | — | — |
| 5 hours | 0.1 | 0.07 | 0.07 | 0.07 | — | — |
| 6 hours | 0.1 | 0.07 | 0.07 | 0.07 | — | — |

The data demonstrate that exposure of stainless steel to a formulation of potassium hydroxide along with ethylenediaminetetraacetate results in an initial corrosive effect, which results in a formation of a passive film, followed by a reduced rate of corrosion over time.

EXAMPLE 3

Cleaning and passivating a pharmaceutical fermentation vessel

Pharmaceutical product present in a stainless steel pharmaceutical fermentation vessel to be cleaned and passivated is removed from the vessel. After the bulk of product is removed, a residue film remains on the stainless steel surface. A diluted (31 ml/liter) composition of 46% KOH (45%), 10% EDTA (39%), and 44% water is sprayed onto the film-coated surface. The film is dislodged dispersed into the composition and removed from the vessel. Free iron ions are liberated from the surface and form an oxide film on the surface The complexed ions of iron are precipitated into the oxide film. The composition removed from the vessel is optionally discarded or recycled.

Within the first 20–30 minutes of contact between the film-coated surface and the alkaline composition, a passive protective oxide film forms on the surface.

Using the method of the invention, stainless steel can be cleaned and passivated in one treatment. The method provides a passive protective film in addition to cleaning stainless steel surfaces.

What is claimed is:

1. A method for removing residue from and passivating a chromium containing stainless steel surface, the method comprising:

(1) contacting the surface with a composition which consists essentially of between about 15 and 50% of an alkaline component, said alkaline component being a hydroxide selected from the group consisting of potassium hydroxide and sodium hydroxide, between about 1 and 15% of a chelant and between about 39 and 84% of water diluted with water to a concentration of 15–45 ml/liter;

(2) maintaining said contacting to dislodge and remove iron ion and chromium ion residue from said surface; and (3) continuing said contacting to provide on said surface a substantially transparent passivating film comprising a portion of said iron ions and said chromium ions in oxidized form and a portion of said iron and chromium ions complexed with said chelant;

whereby a clean surface which is substantially passive to further oxidation is provided.

2. The method of claim 1 wherein said composition includes between about 1% and 15% of a surfactant selected from the group consisting of anionic, cationic, nonionic and zwitterionic surfactants.

3. A method for removing residue from and passivating a chromium containing stainless steel surface, the method comprising:

(1) contacting the stainless steel surface with a composition which consists essentially of:

(a) between about 20 and 35% of an alkaline component, said alkaline component being a hydroxide selected from the group consisting of potassium hydroxide and sodium hydroxide, (b) between 2 and 8% of a chelant and (c) between about 57 and 78% of water, diluted with water to a concentration of 22 to 38 ml/liter, (2) maintaining said contacting to dislodge and remove at least iron ions, chromium ions, and said residue from said surface; and (3) continuing said contacting to provide on said surface a substantially transparent passivating film including at least chromium and iron ions in oxidized form at least partially complexed with said chelant;

whereby a clean surface which is substantially passive to further oxidation is provided.

4. The method of claim 3 wherein said chelant is ethylenediaminetetraacetate.

5. A method for removing residue from and passivating a chromium containing stainless steel surface, the stainless steel including at least iron, chromium, and nickel, the method comprising:

(1) contacting the surface with a composition consisting essentially of:

between about 15 and 50% of an alkaline component, said alkaline component being a hydroxide selected from the group consisting of potassium hydroxide and sodium hydroxide, between about 1 and 15% of ethylenediaminetetraacetate as a chelant, and between about 39 and 84% of water, diluted with water to a concentration of 15 to 45 ml/liter;

(2) maintaining said contacting to dislodge and remove said residue from said surface and to oxidize iron, chromium, and nickel at the surface; and (3) continuing said contacting to provide on said surface a substantially transparent passivating film including oxides of at least chromium, iron, and nickel complexed with the ethylenediaminetetraacetate;

whereby a clean surface which is substantially passive to further oxidation is provided.

* * * * *